United States Patent [19]

White et al.

[11] 4,309,839

[45] Jan. 12, 1982

[54] SHEET MATERIAL DEVICE WITH LOOSELY ROTATABLE MEMBER

[76] Inventors: David L. White; Beverly A. White, both of 32560 Mason Ct., Westland, Mich. 48185

[21] Appl. No.: 136,364

[22] Filed: Apr. 1, 1980

[51] Int. Cl.[3] ..... A63H 3/38

[52] U.S. Cl. ..... 46/36; 46/167

[58] Field of Search ..... 46/135 R, 167, 36, 34, 46/37; 40/421, 425

[56] References Cited

U.S. PATENT DOCUMENTS

| | | | |
|---|---|---|---|
| 970,531 | 9/1910 | Morgan | 46/135 R X |
| 1,061,965 | 5/1913 | Daly et al. | 46/167 |
| 1,598,497 | 8/1926 | Oswald | 46/135 R X |
| 2,519,499 | 8/1950 | O'Sullivan et al. | 46/135 R X |
| 2,658,304 | 11/1953 | Ferrier | 46/36 |
| 2,749,657 | 6/1956 | Lohnes | 46/34 |
| 3,099,894 | 8/1963 | Carroll | 46/135 R |

*Primary Examiner*—F. Barry Shay
*Attorney, Agent, or Firm*—Charles W. Chandler

[57] ABSTRACT

An amusement device, such as a doll, comprising a body member of a relatively rigid paperboard having a plurality of circular openings, a controlled member on the front of the body adjacent each of said openings, a handle on the rear side of the body, each controlled member having a pair of spaced tabs extending through a corresponding opening in the handle, and a washer having a pair of spaced slots, mounted rearwardly of the handle and receiving the tabs in such a manner that as the handle is moved in a closed path of motion, each of the controlled members is rotated with respect to the body. The controlled members can take the shape of eyes or objects on the front of the doll.

8 Claims, 5 Drawing Figures

SHEET MATERIAL DEVICE WITH LOOSELY ROTATABLE MEMBER

BACKGROUND OF THE INVENTION

This invention is related to an amusement device, such as a paper doll, having a plurality of controlled members on one side of the body rotated by a handle mounted on the rear of the body as the handle is moved in a closed path of motion.

Paper dolls and other devices are frequently formed with movable parts to create an illusion of motion depending upon the characters printed on the body of the doll.

SUMMARY OF THE INVENTION

The broad purpose of the present invention is to provide an improvement over paper devices having movable elements, such as dolls, in which several relatively movable members on one side of the doll are simultaneously but independently rotated as a handle on the opposite side of the doll is moved in a closed curved path of motion. The invention can be incorporated to move various doll features, such as eyes, a bow tie, nose, ears, hands, and the like.

The invention is useful for other paper devices, such as greeting cards and the like where various parts are moved with respect to the body of the card.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
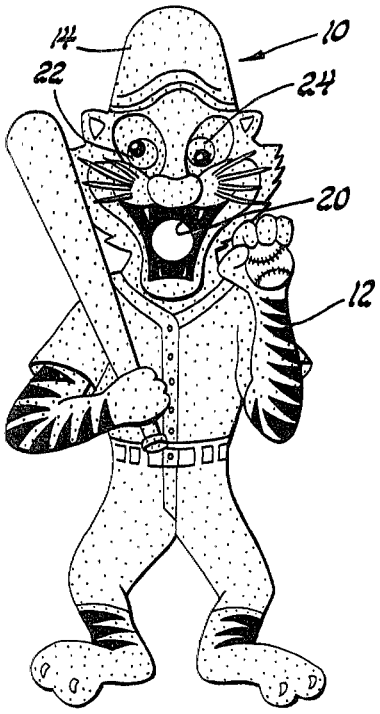
FIG. 1 is a view of the front face of a doll illustrating the preferred embodiment of the invention.
Figure 2:
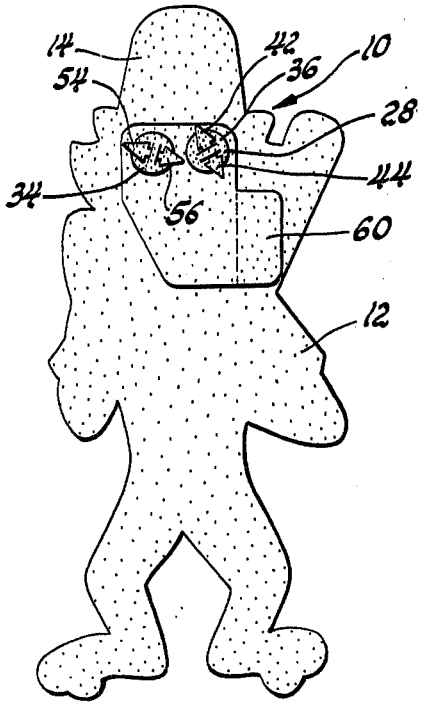
FIG. 2 is a view of the rear face of the preferred doll.

A preferred amusement device comprises a doll 10 having a body member 12, formed of a stiff paperboard. Body 12 has a head 14 having eye openings 16 and 18 and a mouth opening 20. An eye 22 and an eye 24 comprise a pair of controlled members. Eyes 22 and 24 are also formed of a stiff paperboard.

Figure 3:
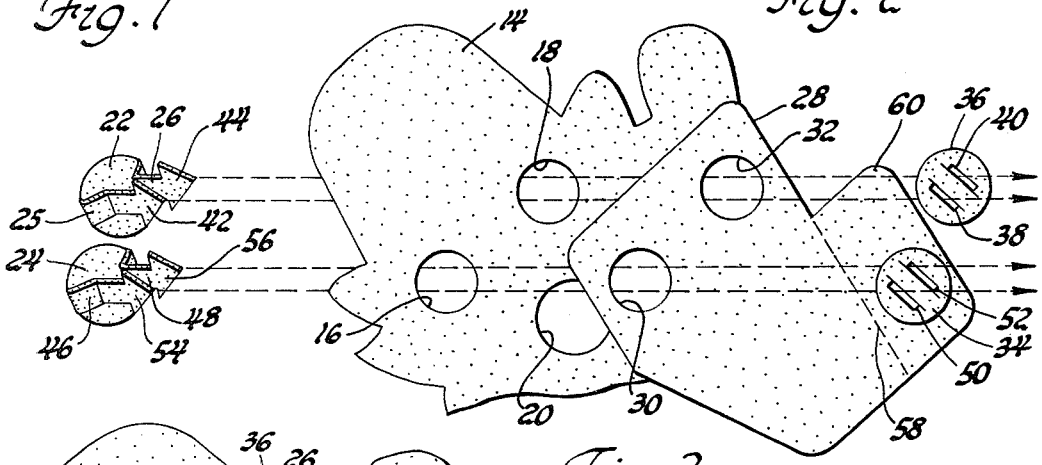
FIG. 3 is an exploded view of the doll head.

Eye 22 has a pair of integrally formed tabs 25 and 26, as illustrated in FIG. 3. The body of eye 22 has a diameter larger than opening 18. Tabs 25 and 26 are bent rearwardly and disposed in opening 18.

A handle 28 is mounted behind the body and is also formed of a stiff paperboard. Handle 28 has a pair of openings 30 and 32 spaced a distance accomodating the distance between openings 16 and 18. Preferably, the diameter of each opening in the handle is substantially identical to the diameter of its companion opening in the doll head. However, the diameter of openings 16 and 30 does not have to be identical to the diameter of openings 18 and 32.

A pair of washers 34 and 36 are mounted rearwardly of handle 28. Washer 36 has a pair of spaced, parallel slots 38 and 40 receiving tabs 25 and 26. The outer ends of tabs 25 and 26 are enlarged at 42 and 44 to provide a width greater than the length of slots 38 and 40 to prevent the tabs from being accidentally separated from the washers. The midsection of the slots is enlarged to form an opening having a length accomodating the narrow midsection of the tabs.

Similarly, eye member 24 has a pair of integrally attached tabs 46 and 48 extending from opposite side edges of the eye member. The two tabs are bent rearwardly and pass through opening 16 in head 14 and opening 30 in the handle. Washer 34 has a pair of spaced, parallel slots 50 and 52 which receive tabs 46 and 48, respectively. Tabs 46 and 48 have enlarged ends 54 and 56 which have a width greater than the length of slots 50 and 52 so that the tabs cannot be accidentally removed from the washer. The slots of washer 34 each has an enlarged midsection in the same manner as the slots of washer 36. It is to be noted that the width of the tabs is less than the diameter of the holes of openings 16 and 18 and openings 30 and 32 in the handle so that the two eye members 22 and 24 are rotatable with respect to their eye openings.

Referring to FIG. 1, handle 28 is marked on its front side to illustrate a tongue that is viewable through opening 20.

The handle has a fold line 58 defining a tab 60 which is bent at right angles to the body of the handle.

Figure 4:
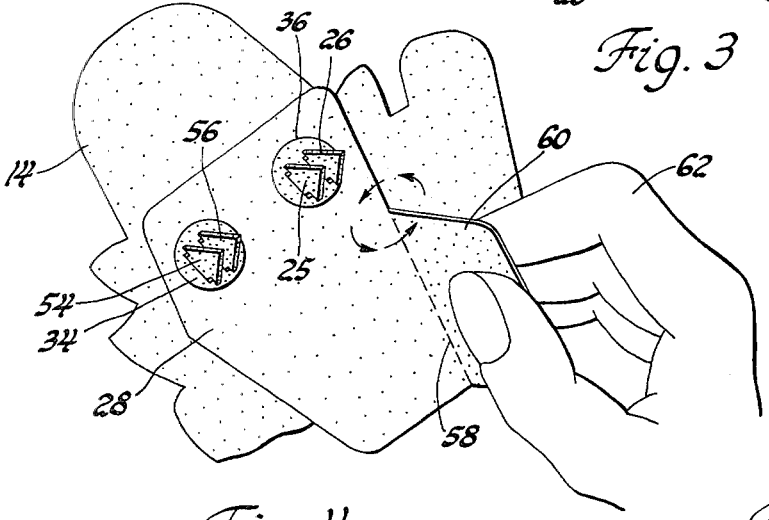
FIG. 4 is a view illustrating the manner in which the handle is moved in a closed curved path of motion.
Figure 5:
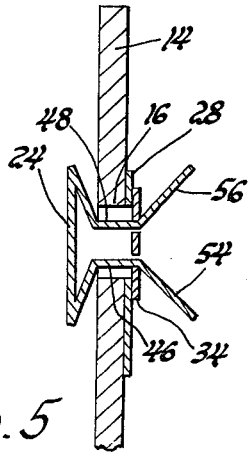
FIG. 5 is a cross-sectional view through one of the openings in the doll body.

Referring to FIG. 4, the user manipulates the controlled members by grasping tab 60 with his fingers 62 and moving the handle in a curved path. As the handle is moved, it moves the tabs such that the side edges of the tabs engage the perimeter of their respective openings so that the tabs advance around the opening perimeter and thus rotate the eye member. Eye members 22 and 24 in response to the curved path of motion, rotate independently of one another in their respective openings so as to provide a simulated eye motion. As the handle is being moved, the tongue moves with the eyes.

Although the preferred embodiment is illustrated with two controlled members, several controlled members can be simultaneously operated in various locations on the body by moving a single control handle in a curved path.

Having described our invention, we claim:

1. An amusement device, comprising:

a body member formed of sheet material, said body member having a front side and a rear side, and a first opening and a second opening extending between said front side and said rear side;

a first controlled member disposed adjacent the front side of said body adjacent said first opening and having a diameter larger than said first opening;

a handle having an opening and being disposed adjacent the rear side of said body member adjacent said first and said second openings;

first means connecting the first controlled member and the handle through said first opening such that the first controlled member is loosely rotatably movable in said first opening with respect to said body member as the handle is moved with respect to the body member;

a second controlled member disposed adjacent the second opening on the front side of the body, the second controlled member having a diameter larger than the second opening; a pair of tab means disposed in said second opening so as to be rotatably movable therein, each of said tab means having one end connected to the second controlled member in spaced relationship;

the opposite ends of said tab means passing through the handle opening in loosely rotatable relation thereto;

a washer member disposed adjacent and rearwardly of the handle opening and having a diameter larger than the handle opening; and said washer having opening means for receiving and connecting the tab means such that as the handle is moved in a closed curved path of motion, the second controlled member is rotated with respect to said body member.

2. An amusement device as defined in claim 1, in which the second controlled member and said tab means are integrally formed of a sheet material, the tab means extending from opposite sides of the second controlled member.

3. An amusement device as defined in claim 1, said first means including tab means connecting the first controlled member to the handle such that as the handle is moved in said motion, the first controlled member is rotated with respect to said body member.

4. An amusement device as defined in claim 1, in which the first controlled member, the second controlled member, said washer, and said handle are each formed of a sheet material.

5. An amusement device as defined in claim 1, in which said body member has a third opening adjacent the handle for exposing a portion of the handle through the front side of the body member.

6. An amusement device as defined in claim 1, in which the opening means in the washer member comprise a pair of spaced slots, each slot receiving one of said pair of tab means.

7. An amusement device, comprising:

a body member formed of sheet material, said body member having a front side and a rear side, and a first opening extending between said front side and said rear side;

a handle having an opening being disposed adjacent the rear of said body member, adjacent said first opening, and means connecting said handle in loosely rotatable relation to said body member at a location spaced from said first opening;

a first controlled member disposed adjacent the first opening on the front side of the body, said first controlled member having a diameter larger than the first opening;

a pair of tab means disposed in said first opening so as to be rotatably movable therein, each of said tab means having one end connected to the first controlled member and in spaced relationship;

the opposite end of said tab means passing through the handle opening in loosely rotatable relation thereto;

a washer member disposed adjacent and rearwardly of the handle opening and having a diameter larger than the handle opening; and said washer member having a pair of spaced slots receiving the tab means such that as the handle is moved in a curved closed path of motion, the first controlled member is rotated with respect to said body member.

8. An amusement device as defined in claim 7, in which the controlled member is moved in a closed curved path in the opposite direction as the motion of the handle.

* * * * *